United States Patent [19]

Miller

[11] 4,382,541

[45] May 10, 1983

[54] INDICATOR FLAG FOR RURAL MAIL BOX

[76] Inventor: Lester E. Miller, 21 W. Mesquite Pl., Green Valley, Ariz. 85614

[21] Appl. No.: 180,198

[22] Filed: Aug. 22, 1980

[51] Int. Cl.[3] ..... B65D 91/00

[52] U.S. Cl. ..... 232/35; 232/17

[58] Field of Search ..... 232/35, 34, 17

[56] References Cited

U.S. PATENT DOCUMENTS

| | | | |
|---|---|---|---|
| 2,613,031 | 10/1952 | Joyce | 232/35 |
| 3,080,107 | 3/1963 | Lindahl | 232/35 |
| 3,559,878 | 2/1971 | Roeder | 232/35 |
| 3,650,464 | 3/1972 | Lewis | 232/35 |
| 3,722,460 | 3/1973 | James, Sr. | 232/35 |
| 3,794,240 | 2/1974 | Myers | 232/35 |
| 4,182,479 | 1/1980 | Swift | 232/35 |

*Primary Examiner*—Francis K. Zugel
*Assistant Examiner*—Peter A. Aschenbrenner
*Attorney, Agent, or Firm*—James C. Wray

[57] ABSTRACT

A mail box indicating device which permits a visual determination from a distance whether the mail box door has been opened. The mail box indicating device consists of a mail box with an upper and lower section separated by the mail box floor. A metallic strip is connected to the mail box floor in the lower section. The indicator means is attached at one end and has a magnet disposed at the other end which contacts the metallic strip until that end of the indicator means is released by opening the door of the mail box.

10 Claims, 4 Drawing Figures

FIG. 1
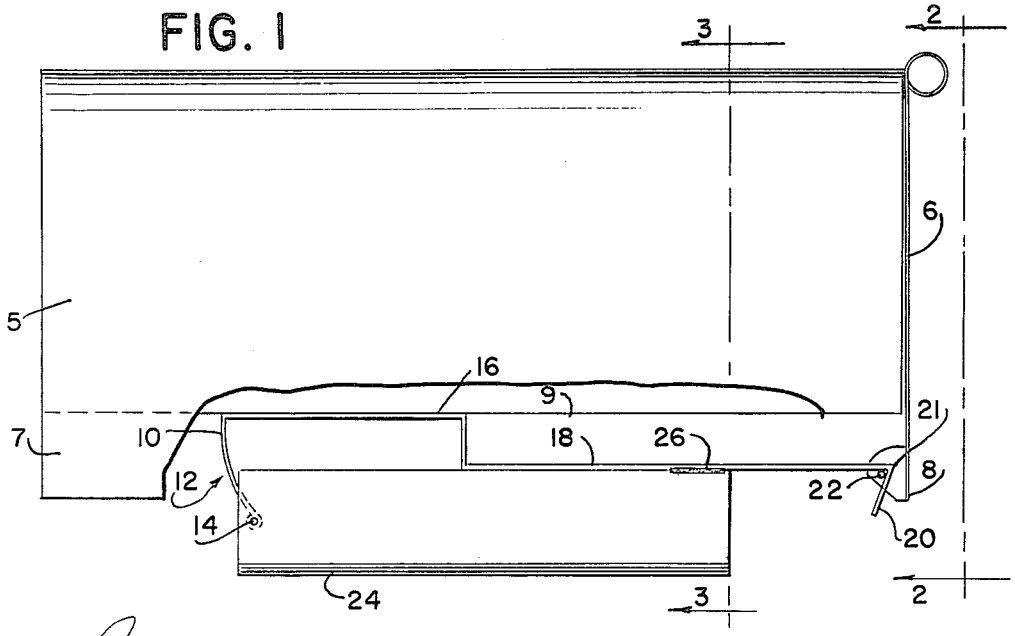
FIG. 3
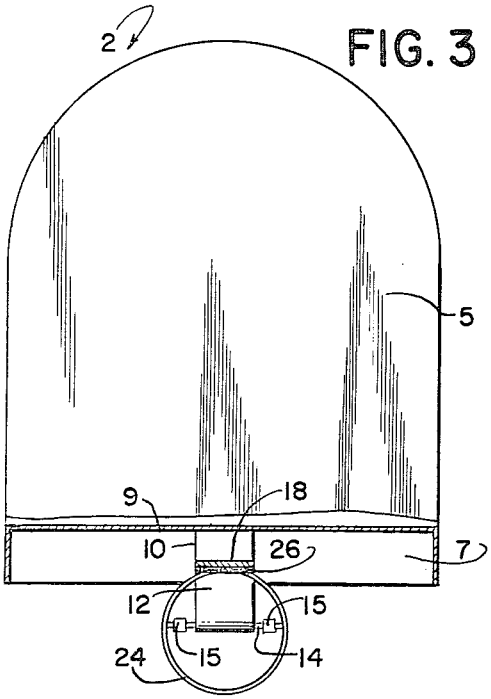
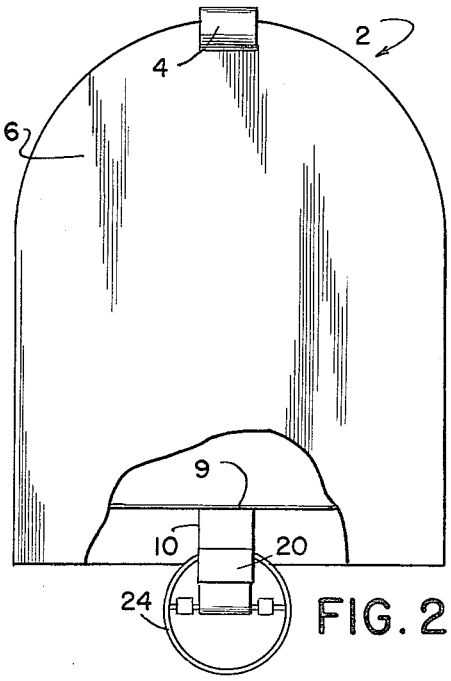
FIG. 2
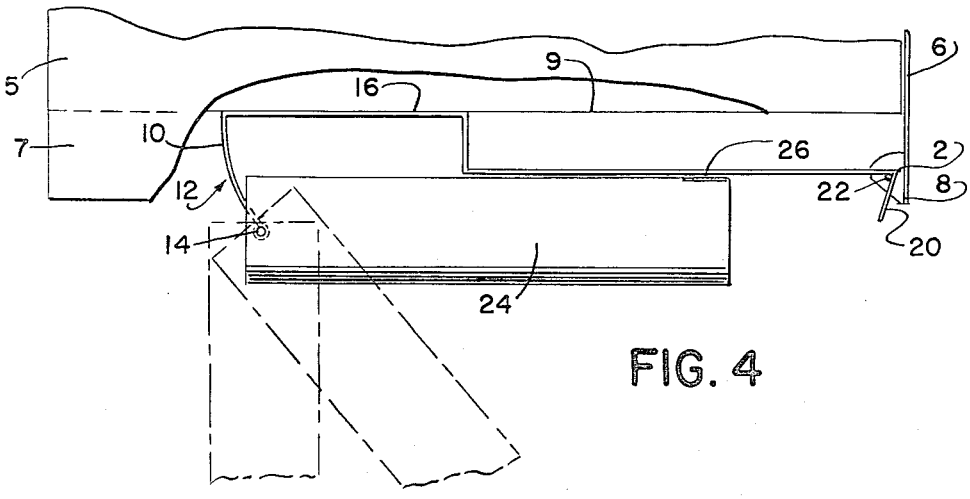
FIG. 4

INDICATOR FLAG FOR RURAL MAIL BOX

BACKGROUND OF THE INVENTION

In rural areas where there is some distance between the dwelling and the mail box, there is a desire to be able to tell whether mail has been placed into the mail box. To do this, some indicating means is necessary. This means must be visible at a distance.

Without an indicating means visible at a distance, a person would be required to physically open the mail box to conclude mail has been placed into the box.

SUMMARY OF INVENTION

The present invention relates to a mail box indicating device visible at a distance when deployed.

The indicator of the present invention will be displayed automatically when the door of the mail box is opened. Once the indicator is released and deployed, it can be manually reset after the mail box door is closed.

An object of the invention is to provide a mail box indicating means visible from a distance to show the mail box door has been opened.

Another object of the invention is to provide a protective area into which the indicating means is disposed when indicating means is not being used for indication.

Still another object of the invention is to provide a method for releasing, deploying and resetting an indicating means.

DESCRIPTION OF THE DRAWINGS

FIG. 1 is a side view of the mail box indicating apparatus with the indicator in the up and and attached position.

FIG. 2 is an end view of FIG. 1 at 2—2.

FIG. 3 is a cross sectional view of FIG. 1 at 3—3.

FIG. 4 is a side view with the indicator in the up position with phantom lines showing the indicator in the down and deployed position.

DETAILED DESCRIPTION OF THE DRAWINGS

FIG. 1 shows the mail box structure and indicating means generally at 2. The upper section 5 and lower section 7 of the mail box are divided by a separating means 9. This separator 9 can be continuous or substantially continuous. Mail box door 9 is disposed over one end of the mail box, extending over both the upper section 5 and lower section 7. Door 6 has handle 4 for opening the door of the mail box.

Lower section 7 houses the indicating means. Lower section 7 provides protection for the indicator 24 and metallic strip 10. The base of lower section 7 is open. A bent metallic strip, generally shown at 10, has portion 16 which is attached by gluing or other attaching methods to the underside of separator 9. Metallic strip 10, has portion 18 which is parallel to separator 9, but spaced away from the separator. An end portion 20 of strip member 10 is angled at 21 about door pivot member 22 to form an angle of less than 90° in respect to portion 18, of the metallic strip 10.

Indicator 24 is a P.V.C. pipe. One end of pipe 24 is drilled and attaches to the curved end 12 of the metallic strip 10 by pin 14 passing through opposing walls of the pipe and end 12 of strip 10. The opposite end of pipe 24 has a plastic magnet 26 fixed thereon. Magnet 26 is attracted to the metallic strip at portion 18. The indicator 24 is kept in the up and attached position by the magnet 26.

FIGS. 2 and 3 show views of the mail box indicating apparatus at 2—2 and 3—3 respectively. In FIGS. 2 and 3, shaft 14 which engages indicator means 24 and portion 12 of strip 10 is kept in place by spaced bushings 15 mounted on said shaft 14. In FIG. 3, the end of indicator 24 is shaped to receive magnet 26. The magnet 26 is disposed so that it is parallel to portion 18 of metallic strip 10. The parallel relationship between magnet 26 and portion 18 allow for maximum surface contact and attraction between the two surfaces.

In FIG. 4, the indicator 24 is in the up, nondeployed position. To release the indicator 24 from the position as shown in FIG. 4, the following is the method of operation of the mail box indicating apparatus. Handle 4 of door 6 is pulled and then rotates clockwise about member 22 away from the upper section 5 of the mail box 2. End 8 of door 6 is rotated into lower section 7. As door 6 is rotated clockwise end 8 contacts end 20 of strip 10. The clockwise rotation of the door bends end 20 toward portion 18. The bending of end 20 causes portion 18 to flex upward toward separator 9. The flexing of portion 18 causes magnet 26, fixed to indicator 24, to break contact with metallic strip member 18. The breaking of contact between magnet 26 and portion 18 releases one end of indicator 24. The released end of the indicator rotates clockwise due to gravity about pin 14. The indicator 24 can now be seen at a distance and indicates the mail box had been opened by the vertical hanging position of the indicator as shown in phantom lines in FIG. 4.

To reset the indicator 24, door 6 is closed, unflexing portion 18 and unbending end 20. Indicator 24 is rotated counterclockwise about pin 14 until magnet 26 contacts portion 18 of metallic strip 10 and the indicator remains in the up and attached position.

While the invention has been described with reference to a specific embodiment, it will be obvious to those skilled in the art that modifications and variations can be made without departing from the teachings of the invention. The scope of the invention is defined in the following claims.

I claim:

1. A mailbox opening indicating apparatus comprising a mailbox container having side walls and a top wall and a closed rear wall and having an open front end, the container being divided into upper and lower sections by a separating means which extends between side walls and from the rear wall to the open front end, a closure pivotedly disposed on a front end of the mailbox container and extending over the upper and lower section, an elongated flexible member positioned in the lower section and attached to a bottom of the separating means so that a frontal portion of the elongated flexible member is spaced from the separating means and extending toward a lower part of the door beneath its pivot, whereby when an upper part of the door is swung open around the pivot, the lower part of the door contacts the frontal portion of the elongated member and moves the frontal portion of the elongated member upward, an elongated indicating means having one end pivoted on the lower section of the container and having an opposite end releaseably connected to the elongated member, whereby when the elongated member is moved upward by the opening of the door, connection is broken between the free end of the indicating means and the elongated member, whereupon the indicating means falls around its pivot to a downward indicating position for indicating that the door has been open, and whereby when the door is closed, the door permits the frontal portion of the elongated member to move downward whereupon raising the indicating means about its pivot again connects the indicating means to the frontal portion of the elongated member.

2. The apparatus of claim 1 wherein the free end of the indicating means is releaseably connected to the elongated member by a magnet.

3. The apparatus of claim 2 wherein the magnet is mounted on the free end of the indicating means.

4. The apparatus of claim 1 wherein the elongated member has a rearward portion attached flatly against the separating means and wherein the elongated means has a frontal portion which is cantilevered forward from the rearward portion.

5. The apparatus of claim 4 wherein the elongated portion extends downward from a forward extension of the rearward portion and then extends generally horizontally forward until a position just short of a closed door.

6. The apparatus of claim 5 wherein the elongated member further comprises a downward and inward extending end which is contacted by a lower portion of the door.

7. The apparatus of claim 6 wherein the door is mounted on a pivot which extends between the side walls under a forward portion of the elongated member and rearward of the downward and inward extending end of the elongated member, whereby the door pivot limits downward movement of a frontal portion of the elongated member.

8. The apparatus of claim 1 wherein the elongated member comprises a rearward portion which is attached to the separating means and further comprises a downward extending rearward portion and a pivot mounted in the downward extending rearward portion for pivoting one end of the elongated indicating means.

9. A method of indicating opening of a mailbox door comprising pivoting a door to an open end of a mailbox container above a lower edge of the door, whereby the lower edge of the door moves inward and upward when an upper portion of the door is moved away from the mailbox container to open the mailbox container, flexing a forward extending free portion of an elongated member mounted on the container upward by contacting a forward sloping end portion of the flexible member with a lower edge of the door, moving a connection between the forward portion of the elongated member and a free forward end of a pivoted indicating means away from a complementary connection on the free forward end of the pivoted indicating means, thus causing the free forward end of the indicating means to fall and the indicating means to pivot about a pivot connected between the mailbox container and an end of the indicating means remote from the free forward end.

10. The method of claim 9 wherein the moving of connection means comprises moving a metallic strip upward away from a magnet mounted on an upper portion of a free end of the indicating means.

* * * * *